United States Patent [19]

Pirota et al.

[11] 4,101,247

[45] Jul. 18, 1978

[54] GETTER DEVICE WITH IMPROVED SUPPORT MEMBER

[75] Inventors: Franco Pirota; Nello Violini; Mario Zucchinelli, all of Milan, Italy

[73] Assignee: S.A.E.S. Getters S.p.A., Milan, Italy

[21] Appl. No.: 789,291

[22] Filed: Apr. 20, 1977

[30] Foreign Application Priority Data

May 12, 1976 [IT] Italy ..... 23184 A/76

[51] Int. Cl.[2] ..... F04B 37/02

[52] U.S. Cl. ..... 417/48; 313/180; 313/481

[58] Field of Search ..... 417/48; 313/174, 178, 313/180, 481

[56] References Cited

U.S. PATENT DOCUMENTS

| | | | |
|---|---|---|---|
| 3,508,105 | 4/1970 | Pappadis | 313/178 |
| 3,547,255 | 12/1970 | Kalbfus | 417/48 |
| 3,816,788 | 6/1974 | Reash | 417/48 X |
| 3,829,730 | 8/1974 | Reash et al. | 417/48 X |
| 3,939,376 | 2/1976 | Reash | 313/481 X |

*Primary Examiner*—Carlton R. Croyle
*Assistant Examiner*—Edward Look
*Attorney, Agent, or Firm*—Littlepage, Quaintance, Murphy, Richardson and Webner

[57] ABSTRACT

An improved getter assembly is provided for attachment to the end of a spring-like antenna by means of a tab portion and subsequent insertion into a TV picture tube. The getter assembly comprises a tab portion, a getter container and a support member for distancing the getter container away from the wall of the picture tube wherein the support member and tab portion may be formed from a single length of wire bent to shape.

6 Claims, 4 Drawing Figures

GETTER DEVICE WITH IMPROVED SUPPORT MEMBER

BACKGROUND OF THE INVENTION

The use of getter devices in electronic tubes is well known. A commonly used getter construction consists of a container such as a U-section ring container into which is pressed a material capable of releasing a getter metal vapour upon heating.

A particular type of electron tube which requires the use of a getter device is a television picture tube which generally comprises a neck portion which houses an electron gun structure, an enlarged bulb portion which terminates in a generally flat viewing screen, and a funnel shaped portion joining the neck and bulb portions. It is common practice to mount the getter device at the end of a spring-like metallic strip, commonly called an "antenna-spring", the other end being fixed to the electron gun structure. The spring is tensioned so that it holds the getter device against the wall of the television picture tube in the funnel portion and ensures that the getter device does not block the path of the electrons directed from the electron gun to the viewing screen.

In U.S. Pats. Nos. 3,381,805 and 3,390,758 getter devices for use in the antenna position are described which employ a ceramic member between the getter container and the tube wall to prevent problems of tube cracking which would occur if the getter container were heated, to evaporate the getter metal, while the getter container was in direct contact with the tube wall. However such getter devices are of complex structure as the ceramic member must be held to the getter container by mechanical means such as wires or bars or other securing devices. Furthermore ceramic members increase substantially the overall mass of the getter device which in turn requires that the antenna spring tension be increased. As one end of the antenna spring is attached to the electron gun structure this structure can be subjected to excessive forces which, for instance, in a colour television picture tube can cause the gun structure to be misaligned with respect to the shadow mask, resulting in a reduction of picture quality. An attempt to reduce the weight of the getter device, by using an annular ceramic member, has been proposed in U.S. Pat. No. 3,927,953. However even the provision of an annular ceramic member does not sufficiently reduce the mass of the getter device and still has the defect of being a complicated assembly.

Other getter devices have been described in U.S. Pats. Nos. 3,508,105 and 3,829,730 which employ a wire sled or support member which serves, instead of the ceramic member described above, to distance the getter container from the tube wall. While these getter devices have a relatively low mass it has still proved necessary to provide a separate tab member for attachment of the getter device to the antenna-spring and a separate member to distance the getter container away from the tube wall. However, the use of the minimum number of components in any assembly is always desirable as this reduces the assembly time and thus reduces manufacturing costs, makes automation of the assembly procedure much easier allowing greater manufacturing output at less capital outlay, furthermore it increases reliability of the product as it is less likely that there will be defective components and decreases probability that assembly defects will occur.

It is therefore an object of the present invention to provide a getter device free from one or more defects of present getter devices.

Another object of the present invention is to provide a getter device with a combined tab member and member to distance the getter container away from the electron tube wall.

A further object of the present invention is to provide a getter device using a minimum number of components.

Yet another object of the present invention is to provide a getter device having a reduced manufacturing cost.

Additional objects and advantages of getter devices of the present invention will become apparent to those skilled in the art by reference to the following detailed description thereof and drawings wherein.

In the present invention there is provided a getter assembly comprising a getter container having at least one side wall and a bottom wall connected to said side wall and having getter metal vapour releasing material supported by said bottom wall and side wall, and a wire support member comprising a substantially U-shaped tab portion, secondary support elements and runners made from a simple length of wire bent to shape. The substantially U-shaped tab portion is in the form of an arcuate portion and two slightly distanced substantially parallel arms the arcuate portion of which extends radially outwards in a plane parallel to the plane of the bottom wall to a distance greater than the outer radius of the getter assembly, at least one arm of said tab portion being attached to said bottom wall the ends of each arm opposite the arcuate portion being joined to secondary support elements which secondary support elements increase their separation along their length until said separation is approximately equal to the outer diameter of the getter assembly, each support element terminating at the beginning of one of a pair of similar runners of arcuate configuration individually having a length approximately equal to the outer radius of the getter assembly and extending substantially parallel to one another and substantially parallel to the arms of the tab portion, the concave surface of the runners facing said bottom wall.

The getter container preferably has both an inner side wall and an outer side wall and a bottom wall connecting said inner side wall to said outer side wall. The getter metal vapour releasing material supported by said walls is preferably an alloy of barium and is even more preferably an alloy of barium with aluminum, in approximate weight ratio 50:50, in admixture with an approximately equal weight of metal with which said alloy may react exothermically such as Ni, Co, Fe and others. The U-shaped tab portion may be slightly circular to give a greater surface for attaching the antenna spring. The arms of the tab portion may be attached to the bottom wall at any convenient point such as near the periphery of the getter assembly or near the inner radius or at any point in between.

The term "getter metal vapour releasing material" as used in the specification and claims herein is meant to include both the material prior to and after getter metal vapour release. This term embraces both the material in the form sold with the getter device and in the form in which it is found in an operating tube wherein the bulk of the getter metal has been evaporated from the material and is in the form of a film on the inside surfaces of the tube.

Figure 1:
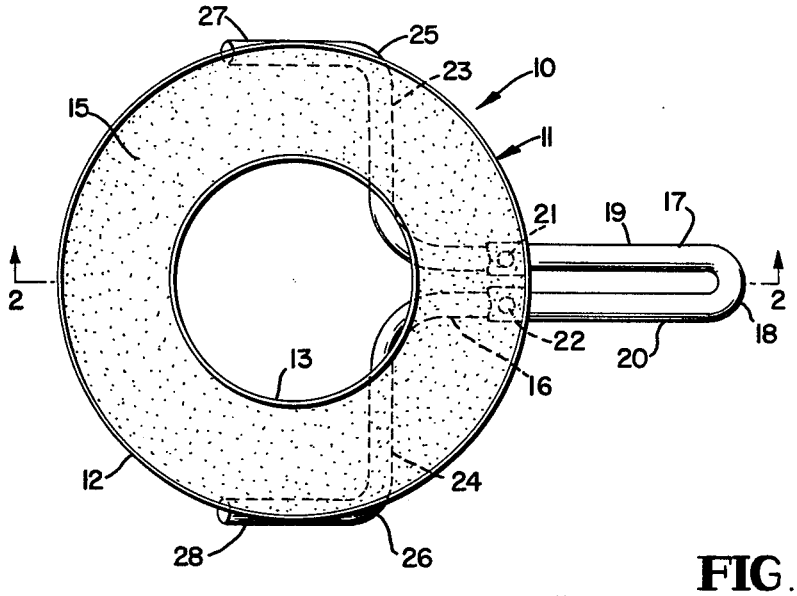
FIG. 1 is a plan view of a getter device of the present invention
Figure 2:
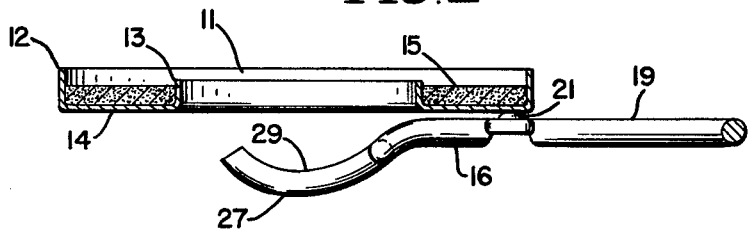
FIG. 2 is a sectional view along line 2—2' of FIG. 1

Referring now to the drawings and in particular to FIGS. 1 and 2 there is shown a getter assembly 10 of the present invention. Getter assembly 10 comprises a getter container 11 having an outer side wall 12, an inner side wall 13 and a bottom wall 14 connected to both outer side wall 12 and inner side wall 13. A getter metal vapour releasing material 15 is supported by said outer side wall 12, inner side wall 13 and bottom wall 14. A circular cross section wire support member 16 is also provided which comprises a substantially U-shaped tab portion 17 in the form of an arcuate portion 18, a first arm 19 and a second arm 20 which are, in this case, substantially parallel to each other. Arcuate portion 18 extends radially outwards from getter assembly 10 in a plane parallel to the plane of bottom wall 14 to a distance greater than the outer radius of the getter assembly 10. First arm 19 is attached to bottom wall 14 by means of a first spot weld 21. Second arm 20 is attached to bottom wall by means of a second spot weld 22. A secondary support element 23 is attached to first arm 19 at the end opposite to arcuate portion 18. Another secondary support element 24 is attached to second arm 20 at the end opposite to arcuate portion 18. Secondary support elements 23 and 24 increase their separation along their lengths in a direction substantially at 180° to each other until said separation is approximately equal to the outer diameter of the getter assembly 10. Secondary support elements 23 and 24 terminate respectively at points 25 and 26 which indicate the beginning of arcuate runners 27 and 28, each having a length approximately equal to the outer radius of the getter assembly 10. Arcuate runmers 27 and 28 extend in a direction substantially parallel to one another in a direction parallel to but away from the tab portion 17 and are also substantially parallel to arms 19 and 20 of tab portion 17. Concave surface 29 of runner 27 faces towards bottom wall 14, similarly for runner 28.

Figure 3:
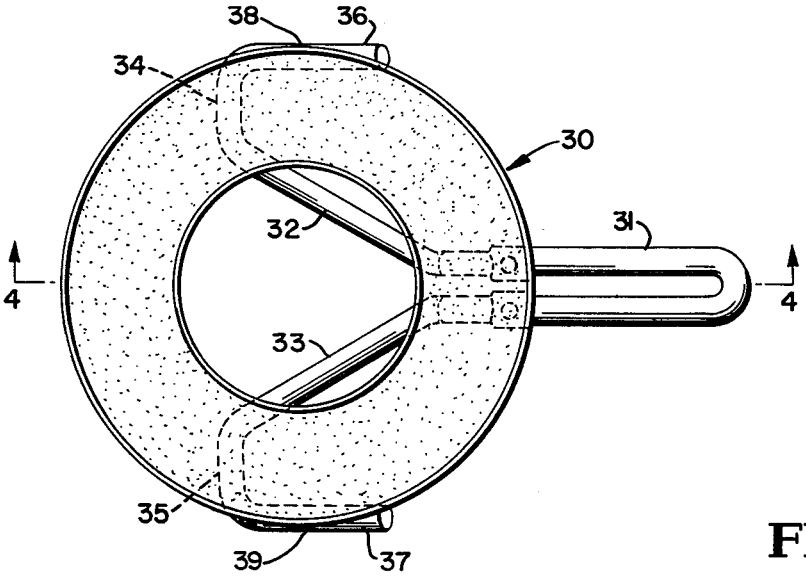
FIG. 3 is a plan view of a further getter device of the present invention
Figure 4:
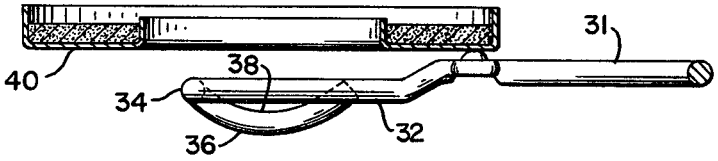
FIG. 4 is a sectional view along line 4—4' of FIG. 3.

FIGS. 3 & 4 show another embodiment of the present invention and show a getter assembly 30 identical in all respects to getter assembly 10 except the wire support member 31 now has secondary support elements 32 and 33 which increase their separation along their lengths in a direction less than 180° to each other until said separation is approximately equal to, but slightly less than, the outer diameter of getter assembly 30. Secondary support elements 32 and 33 terminate respectively at points 34 and 35 which indicate the beginning of arcuate runners 36 and 37 each having a length approximately equal to the outer radius of the getter assembly 30. Arcuate runners 36 and 37 extend in a direction substantially parallel to one another in a direction towards the tab portion and are also substantially parallel to the arms of the tab portion. The concave surfaces 38 and 39 respectively of runners 36 and 37 face towards the bottom wall 40 of getter assembly 30.

It is found that by use of getter assemblies of the present invention the antenna spring tension can be maintained at such a low value that no misalignment of the electron gun assembly takes place. Additionally it is found that manufacture of such devices is easily achieved by mass production methods due to the use of a minimum number of components.

What is claimed is:

1. A getter assembly comprising a getter container having at least one side wall and a bottom wall connected to said side wall and having getter metal vapour relesing material supported by said bottom wall and side wall, and a wire support member comprising a substantially U-shaped tab portion in the form of an arcuate portion and two slightly distanced substantially parallel arms the arcuate portion of which extends radially outwards in a plane parallel to the plane of the bottom wall to a distance greater than the outer radius of the getter assembly, at least one arm of said tab portion being attached to said bottom wall the ends of each arm opposite the arcuate portion being joined to secondary support elements which secondary support elements increase their separation along their length until said separation is approximately equal to the outer diameter of the getter assembly, each support element terminating at the beginning of one of a pair of similar runners of arcuate configuration individually having a length approximately equal to the outer radius of the getter assembly and extending substantially parallel to one another and substantially parallel to the arms of the tab portion, the concave surface of the runners facing said bottom wall.

2. A getter assembly comprising a getter container having at least one side wall and a bottom wall connected to said side wall and having getter metal vapour releasing material support by said bottom wall and side wall, and a wire support member comprising a substantially U-shaped tab portion in the form of an arcuate portion and two slightly distanced substantially parallel arms the arcuate portion of which extends radially outwards in a plane parallel to the plane of the bottom wall to a distance greater than the outer radius of the getter assembly, at least one arm of said tab portion being attached to said bottom wall the ends of each arm opposite the arcuate portion being joined to secondary support elements which secondary support elements increase their separation along their length until said separation is approximately equal to the outer diameter of the getter assembly, each support element terminating at the beginning of one of a pair of similar runners of arcuate configuration individually having a length approximately equal to the outer radius of the getter assembly and extending substantially parallel to one another and substantially parallel to the arms of the tab portion, the concave surface of the runners facing said bottom wall and the direction of the runners being away from the tab portion.

3. A getter assembly comprising a getter container having at least one side wall and a bottom wall connected to said side wall and having getter metal vapour releasing material supported by said bottom wall and side wall, and a wire support member comprising a substantially U-shaped tab portion in the form of an arcuate portion and two slightly distanced substantially parallel arms the arcuate portion of which extends radially outwards in a plane parallel to the plane of the bottom wall to a distance greater than the outer radius of the getter assembly, at least one arm of said tab portion being attached to said bottom wall the ends of each arm opposite the arcuate portion being joined to secondary support elements which secondary support elements increase their separation along their length until said separation is approximately equal to the outer diameter of the getter assembly, each support element terminating at the beginning of one of a pair of similar runners of arcuate configuration individually having a length approximately equal to the outer radius of the getter assembly and extending substantially parallel to one another and substantially parallel to the arms of the tab portion, the concave surface of the runners facing said bottom wall and the direction of the runners being towards the tab portion.

4. A getter assembly at claim 3 in which the wire support member is of circular cross-section and comprises a single length of wire bent to shape.

5. A getter assembly of claim 3 in which both arms of the tab portion are attached to the bottom wall.

6. A getter assembly comprising a getter container having an outer side wall, an inner side wall and a bottom wall connected to both outer side wall and inner side wall, and a getter metal vapour releasing material supported by said walls and a circular cross section wire support member comprising a substantially U-shaped tab portion having an arcuate portion and two arms substantially parallel to each other, the arcuate portion extending radially outwards from said geter assembly in a plane parallel to the plane of said bottom wall to a distance greater than the outer radius of said getter assembly, said arms being attached to said bottom wall and further each comprising a secondary support element, the two secondary support elements making an angle of less than 180° with respect to each other and increasing their separation along their lengths until said separation is approximately equal to the outer diameter of said getter assembly, wherein the terminal points of said support elements indicate the beginning of arcuate runners, having a length approximately equal to the outer radius of said getter assembly said arcuate runners extending in a direction substantially parallel to one another and in a direction towards said tab portion, and being also substantially parallel to the arms of said tab portion, the concave surfaces of said arcuate runners facing towards said bottom wall.

* * * * *